US005651421A

United States Patent [19]

Newton et al.

[11] Patent Number: 5,651,421

[45] Date of Patent: Jul. 29, 1997

[54] ROTARY DRILL BITS

[75] Inventors: Alex Newton, Houston, Tex.; Malcolm R. Taylor, Gloucester, England; John M. Fuller, Nailsworth, England; Andrew Murdock, Stonehouse, England

[73] Assignee: Camco Drilling Group Limited, Stonehouse, England

[21] Appl. No.: 541,771

[22] Filed: Oct. 10, 1995

[30] Foreign Application Priority Data

Nov. 1, 1994 [GB] United Kingdom ..... 9421924

[51] Int. Cl.[6] ..... E21B 10/16

[52] U.S. Cl. ..... 175/431; 175/408

[58] Field of Search ..... 175/431, 432, 175/428, 426, 393, 408, 406

[56] References Cited

U.S. PATENT DOCUMENTS

| | | | |
|---|---|---|---|
| 4,471,845 | 9/1984 | Jurgens | 175/431 |
| 4,942,933 | 7/1990 | Barr et al. | 175/431 |
| 4,981,184 | 1/1991 | Knowlton et al. | 173/429 |
| 4,991,670 | 2/1991 | Fuller et al. | 175/428 |
| 5,090,492 | 2/1992 | Keith | 175/426 X |
| 5,238,075 | 8/1993 | Keith et al. | 175/431 |
| 5,346,025 | 9/1994 | Keith et al. | 175/431 X |
| 5,417,296 | 5/1995 | Murdock | 175/393 |
| 5,443,565 | 8/1995 | Strange, Jr. | 175/431 |

FOREIGN PATENT DOCUMENTS

| | | | |
|---|---|---|---|
| 2086451 | 5/1982 | United Kingdom | 175/431 |
| 2252574 | 8/1992 | United Kingdom . | |

*Primary Examiner*—Hoang C. Dang

[57] ABSTRACT

A rotary drill bit for drilling holes in subsurface formations comprises a bit body having a shank for connection to a drill string, a number of circumferentially spaced blades on the bit body each extending outwardly away from the central axis of rotation of the bit, a number of cutters mounted side-by-side along each blade, and a passage in the bit body for supplying drilling fluid to the surface of the bit for cleaning and cooling the cutters. The blades comprise alternating primary and secondary blades. The cutters on the primary blades are primary cutters which are located at different radial distances from the bit axis so as to define a cutting profile which, in use, covers substantially the whole of the bottom of the bore hole being drilled. At least the majority of the cutters on the secondary blades are secondary cutters each of which is located at substantially the same radial distance from the bit axis as an associated primary cutter on the preceding primary blade.

22 Claims, 3 Drawing Sheets

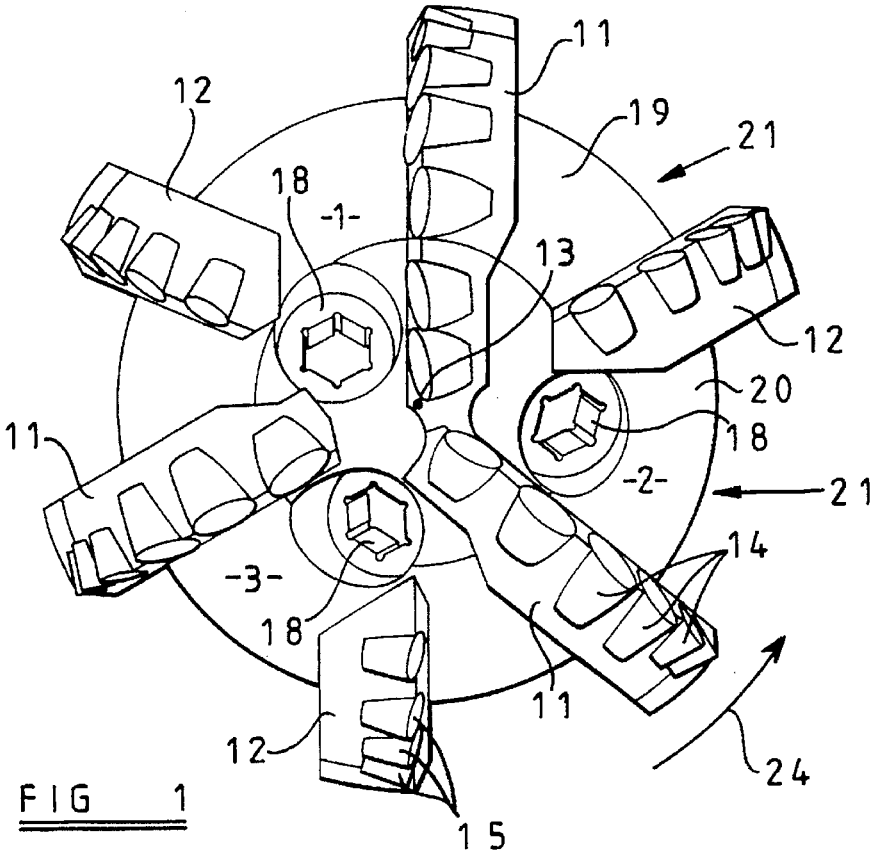
FIG 1
FIG 2
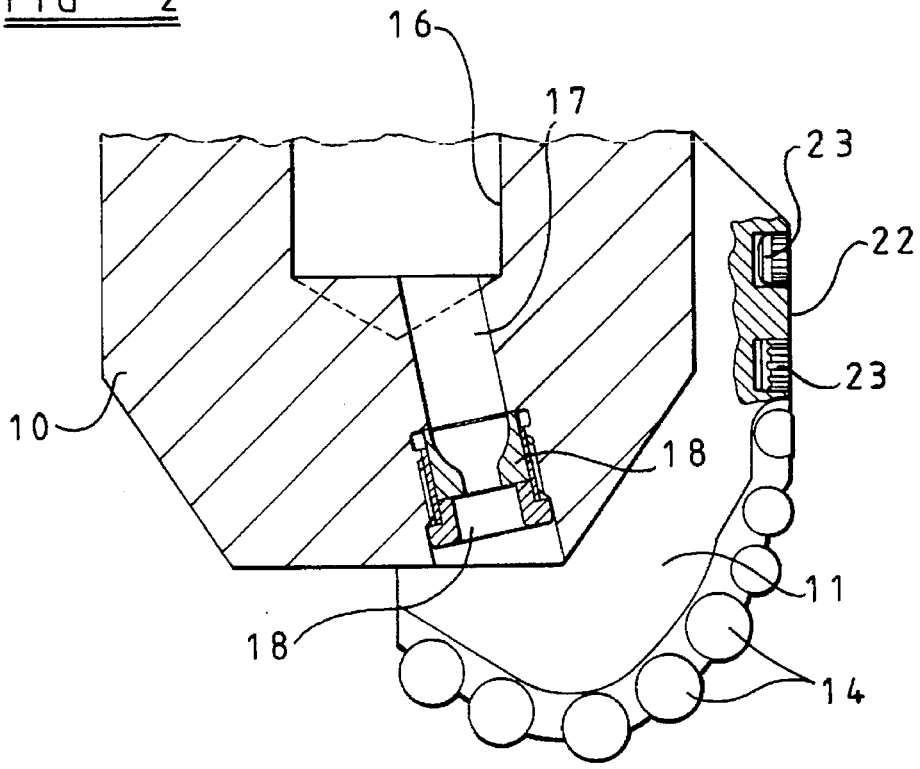

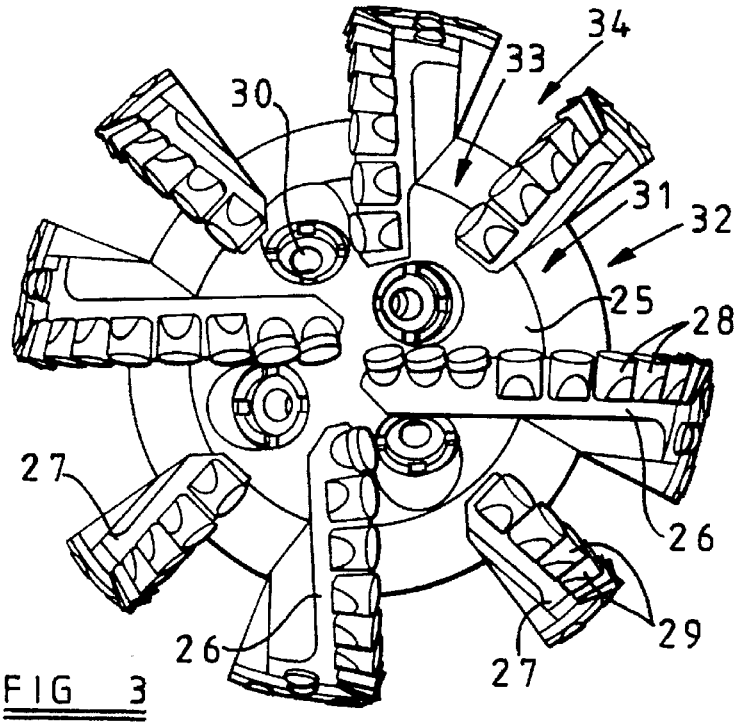
FIG 3
FIG 4
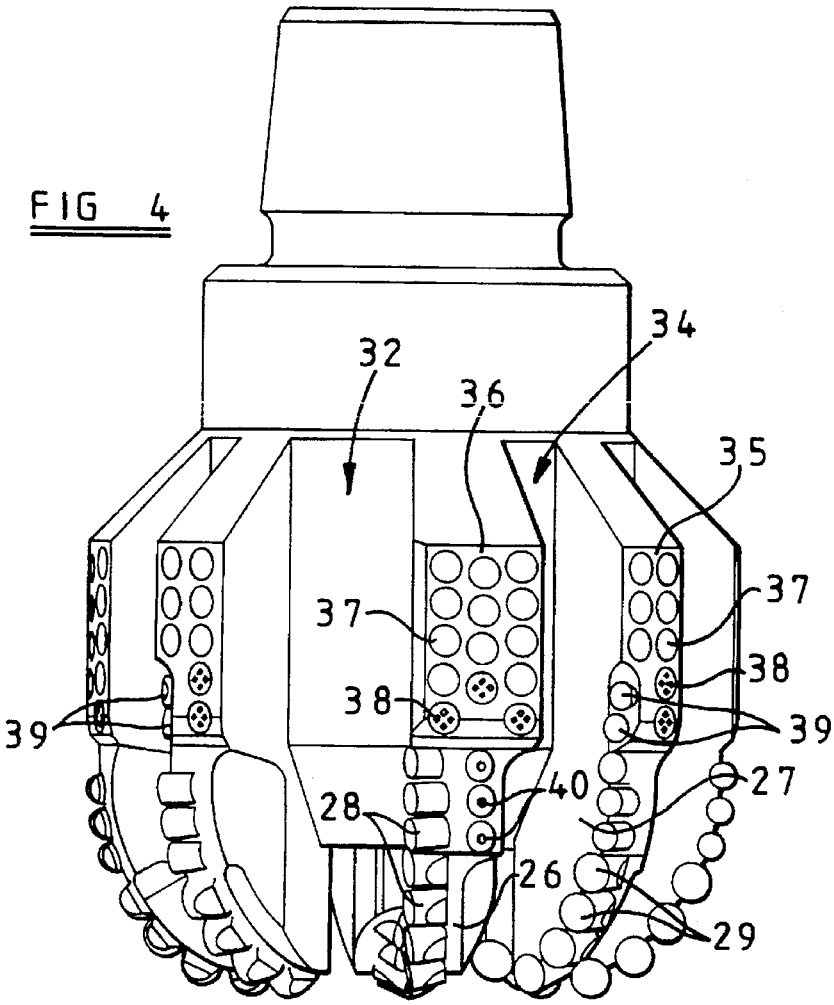

ROTARY DRILL BITS

BACKGROUND OF THE INVENTION

The invention relates to rotary drill bits for drilling or coring holes in subsurface formations, and of the kind comprising a bit body having a shank for connection to a drill string, a plurality of circumferentially spaced blades on the bit body each extending outwardly away from the central axis of rotation of the bit, a plurality of cutters mounted side-by-side along each blade, and a passage in the bit body for supplying drilling fluid to the surface of the bit for cleaning and cooling the cutters.

In rotary bits of this kind, it is usual for the cutters on the various blades to be located at different radial distances from the bit axis so that the cutters together define a cutting profile which, in use, covers substantially the whole of the bottom of the bore hole being drilled. For example, it is common for the cutters to be so positioned on the blades that they form a generally spiral array so that the path swept by each cutter partly overlaps the paths swept by the cutters which are at slightly smaller and slightly greater radial distances from the bit axis.

Drill bits are also known in which the cutters are arranged in a number of generally concentric arrays so as to cut generally concentric annular grooves in the bottom of the bore hole, this being found to enhance the stability of the bit.

Generally speaking, in the case where the cutters are in a spiral array, the stability of the bit in the bore hole increases with increasing number of blades. Thus, a six-bladed bit will generally be more stable than a three-bladed bit, other things being equal. However, it is also found that a bit having a smaller number of blades may perform more efficiently and achieve higher penetration rates, particularly in softer formations. Accordingly, in some formations a three-bladed bit may drill at a fast rate, but it may have a tendency to become unstable, resulting for example in bit whirl, and the cutters on the bit may also tend to wear out rapidly since there is less redundancy of cutters to provide a back up and to share some of the shocks to which a drill bit is subjected in use. In order to overcome the latter problem, back up cutters or abrasion elements are sometimes mounted on each blade rearwardly of the cutters. However, in view of the close proximity of the back up elements to the cutters there may be poor cleaning and cooling of the back up elements and the increased width of the blade required to accommodate the back up elements may increase the frictional rubbing of the blades on the formation.

The present invention sets out to provide a novel form of drill bit which can provide the drilling efficiency of a bit having a smaller number of blades and cutters with the stability and wear resistance of a bit having a greater number of blades.

SUMMARY OF THE INVENTION

According to the invention there is provided a rotary drill bit for drilling or coring holes in subsurface formations, comprising a bit body having a shank for connection to a drill string, a plurality of circumferentially spaced blades on the bit body each extending outwardly away from the central axis of rotation of the bit, a plurality of cutters mounted side-by-side along each blade, and a passage in the bit body for supplying drilling fluid to the surface of the bit for cleaning and cooling the cutters, wherein the cutters on a series of primary blades are primary cutters at least the majority of which are located at different radial distances from the bit axis so as together to define a cutting profile which, in use, covers substantially the whole of the bottom of the bore hole being drilled, and wherein at least the majority of the cutters on a series of secondary blades are secondary cutters each of which is located at substantially the same radial distance from the bit axis as an associated primary cutter.

As a result of this arrangement, the provision of the secondary cutters on secondary blades provides additional stability and cutter redundancy, but since the secondary cutters are at the same radial distances as primary cutters, most of the cutting (for example about 80%) is performed by the primary cutters. Consequently such a bit may perform with similar efficiency to a bit having only the same number of blades as the number of primary blades, but may have the stability and redundancy, and hence wear characteristics, of a bit having twice as many blades.

The blades may extend generally radially outwards from the bit axis. Preferably each secondary blade carrying secondary cutters is the next adjacent blade rearwardly of the primary blade which carries the primary cutters associated with those secondary cutters. (In this specification, in relation to the relative location of cutters blades on the drill bit, expressions such as "forwardly", "rearwardly", "preceding" and "following" refer to relative positions in relation to the normal direction of forward rotation of the drill bit.)

Since most of the cutting is effected by the primary cutters, the secondary cutters require less cleaning and cooling by the drilling fluid. Accordingly, the flow volume associated with each primary blade is preferably greater than the flow volume associated with each secondary blade, where the flow volume comprises the space which, in use, is enclosed between said blade, the preceding blade, the bit body, and the surrounding formation. Such arrangement may be achieved by so locating the secondary blades that the angular separation between each secondary blade and its preceding primary blade is less than its angular separation from the following primary blade.

In any of the above arrangements the number of secondary blades is preferably equal to the number of primary blades, each secondary blade being located between two circumferentially spaced primary blades.

In one specific embodiment there are provided three primary blades and three secondary blades. In an alternative embodiment there are provided four primary blades and four secondary blades.

The primary blades may be substantially .equally circumferentially spaced around the bit body, and the secondary blades may be also substantially equally circumferentially spaced around the bit body. However, in some cases non-equal spacing may be preferred to improve the dynamic behaviour of the bit in use.

Preferably each cutter includes a preform cutting element comprising a facing table of polycrystalline diamond or other superhard material bonded to a substrate of less hard material, such as cemented tungsten carbide. The cutting element may be bonded to a support post or stud which is received in a socket in the bit body or the substrate itself may be of sufficient length that it may be directly received in a socket in the bit body. Such preform cutting elements are often circular in form although the invention includes within its scope the use of cutting elements of other configurations.

The secondary cutters may be of similar configuration to the primary cutters and may be smaller, of equal size, or larger than the primary cutters.

In a preferred embodiment of the invention, there is provided at the outer extremity of each blade a gauge pad which, in use, bears on the side wall of the bore hole being drilled, the primary gauge pads, at the extremities of the primary blades, being of greater circumferential width than the secondary gauge pads at the extremities of the secondary blades. Alternatively, the secondary gauge pads may be of greater circumferential width than the primary gauge pads, or of the same width.

Alternatively or additionally the primary gauge pads may be adapted to have less cutting or abrading effect on the formation than the secondary gauge pads. For example, each primary gauge pad may include only bearing and/or abrading elements which are substantially flush with the surface of the gauge pad, while each secondary gauge pad may include gauge cutters which project outwardly beyond the surface of the gauge pad for removal of material from the surrounding formation.

In a further embodiment of the invention there is provided a drill bit having two primary blades and two secondary blades. In this case the primary blades may be interconnected at the central axis of the bit, and the inner extremities of the secondary blades may be spaced from the bit axis so that the flow volumes preceding and following each secondary blade are interconnected by a throat portion between the inner extremity of the secondary blade and the interconnected primary blades.

In any of the above arrangements the relative orientations of a secondary blade and its associated primary blade may be such that the angular circumferential separation between the secondary cutters and their associated primary cutters decreases with distance from the bit axis. For example, this may be achieved by each primary blade extending generally radially with respect to the bit axis, whereas each secondary blade is inclined forwardly with respect to the radial direction.

BRIEF DESCRIPTION OF THE DRAWINGS

FIG. 1 is an end view of one form of rotary drill bit according to the invention, FIG. 2 is a part-section through the drill bit of FIG. 1, FIG. 3 is an end view of another form of drill bit, FIG. 4 is a side elevation of the drill bit of FIG. 3, and FIGS. 5 and 6 are diagrammatic end views of further alternative forms of drill bit.

DETAILED DESCRIPTION OF THE PREFERRED EMBODIMENTS

Figure 5:
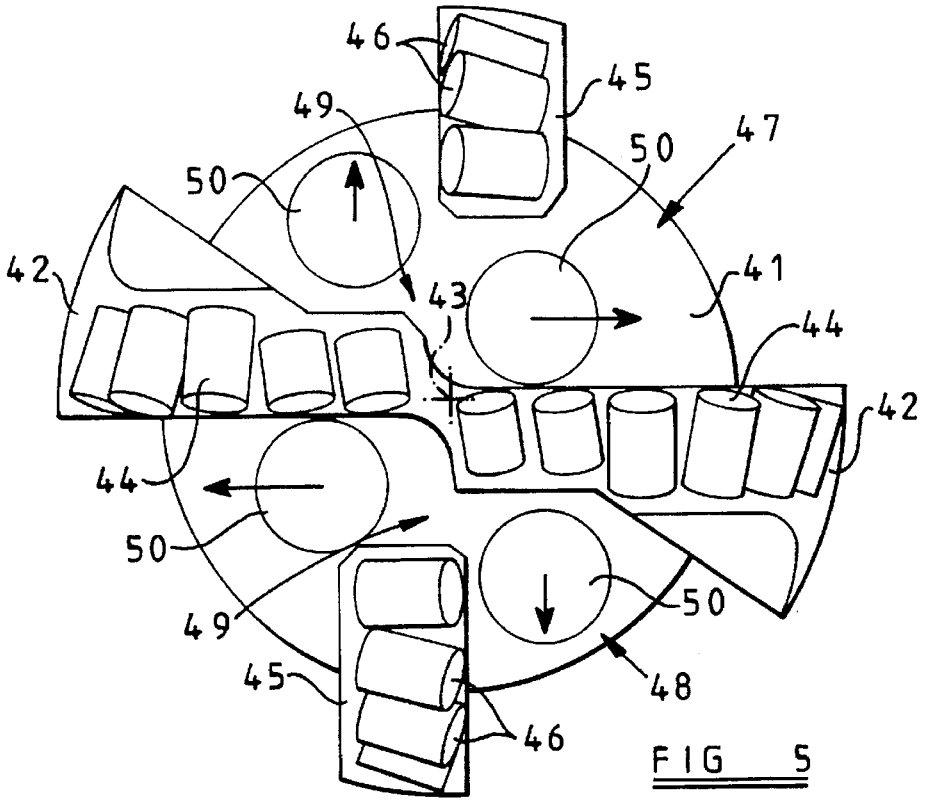

Referring to FIGS. 1 and 2, the drill bit comprises a bit body 10 on which are formed three primary blades 11 and three secondary blades 12. The blades extend generally radially with respect to the bit axis 13 and the leading edges of the blades are substantially equally spaced around the circumference of the bit body.

Primary cutters 14 are spaced apart side-by-side along each primary blade 11 and secondary cutters 15 are spaced apart side-by-side along each secondary blade 12.

Each cutter 14, 15 is generally cylindrical and of circular cross section and comprises a front facing table of polycrystalline diamond bonded to a cylindrical substrate of cemented tungsten carbide. Each cutter is received within a cylindrical socket in its respective blade.

The bit body 10 is formed with a central passage 16 which communicates through subsidiary passages 17 with nozzles 18 mounted at the surface of the bit body. In known manner drilling fluid under pressure is delivered to the nozzles 18 through the passages 16, 17 and flows outwardly through the spaces 19, 20 between adjacent blades for cooling and cleaning the cutters. The spaces 19, 20 lead to junk slots 21 through which the drilling fluid flows upwardly through the annulus between the drill string and the surrounding formation. The junk slots 21 are separated by gauge pads 22 which bear against the side wall of the bore hole and are formed with bearing or abrasion inserts 23. The gauge pads 22 on the primary blades 11 are of substantially the same circumferential width as the gauge pads on the secondary blades 12.

In this embodiment, as well as in those to be described, the bit body and blades may be machined from metal, usually steel, which may be hardfaced. Alternatively the bit body, or a part thereof, may be moulded from matrix material using a powder metallurgy process. The methods of manufacturing drill bits of this general type are well known in the art and will not be described in detail.

The primary cutters 14 on the primary blades 11 are all disposed at different radial distances from the bit axis 13 and are arranged to lie on a spiral so that the circular path swept by each primary cutting element 14 overlaps the adjacent circular paths swept by the cutters which are disposed at the next smaller and next greater radial distances from the bit axis 13. Normally cutters at adjacent radial distances will be on different primary blades.

Each secondary cutter 15, however, is disposed at the same radial distance from the bit axis 13 as one of the primary cutters on the blade immediately preceding it with respect to the normal direction of forward rotation of the bit, as indicated by the arrow 24. In the arrangement of FIG. 1 the secondary cutters 15 are smaller than the primary cutters 14. For example the primary cutters 14 may be 19 mm in diameter, whereas the secondary cutters are 13 mm in diameter.

The secondary cutters may be so disposed that their cutting edges, i.e. the portion of the periphery of the cutter which engages the formation, lie substantially on the primary cutting profile defined by the paths swept by the cutting edges of the primary cutters during each rotation of the drill bit. That is to say, the cutting edge of each secondary cutter is at substantially the same position with respect to the formation as the cutting edge of its associated primary cutter. In this case the secondary cutter, following in the groove in the formation formed by its associated primary cutter, will have little or no cutting effect on the formation and will serve mainly as a stabilising back up for the primary cutter. Alternatively, however, the secondary cutter may be so located that its cutting edge lies further from the bit body than the primary cutting profile. In this case the secondary cutter projects downwardly slightly beyond the cutting edge of its associated primary cutter so as to remove a further cutting of formation from the bottom of the groove formed by its associated primary cutter. In this case the secondary cutters may contribute to the drilling effect during normal operation, but the arrangement is preferably such that this is limited to approximately 20% of the combined cutting effect of the primary and secondary cutters. In a further possible alternative arrangement the cutting edges of the secondary cutters may lie nearer the bit body than the primary cutting profile.

As may be seen from FIGS. 1, 3, 5 and 6, in all of the described arrangements each of the primary and secondary cutters is oriented so as to have negative back rake, i.e. the from facing table of the cutter is inclined forwardly, in the normal direction of forward rotation of the drill bit, as the facing table extends away from the cutting profile and towards the bit body.

In each case most of the cutting of the formation is effected by the primary cutters so that the drill bit operates, in effect, like a three bladed drill bit resulting in fast and efficient drilling rates, particularly in softer formations. However, the provision of the secondary cutting elements 15 on separate secondary blades has the effect that from the point of view of stability and redundancy of cutters the drill bit acts like a six-bladed drill bit.

The primary blades are shown as being substantially equally spaced at approximately 120 degrees from one another although arrangements in which the primary blades are not equally spaced are possible, since this may in some cases improve the dynamic behaviour of the bit in use. As will be described more fully in relation to the embodiment of FIGS. 3 and 4, each secondary blade 12 may be closer to its associated preceding primary blade than it is to the following primary blade. The angle between each secondary blade and its associated preceding blade may be in the range of 30–60 degrees.

FIGS. 3 and 4 show another form of drill bit according to the invention, where the bit body 25 is formed with four primary blades 26 and four secondary blades 27. In the arrangement shown the primary blades 26 are again substantially equally spaced, but arrangements are possible where the blades are not equally spaced.

Primary cutters 28 are spaced apart side-by-side along each primary blade 26 and, as in the arrangement of FIGS. 1 and 2, the cutters 28 are arranged in a generally spiral configuration over the drill bit so as to form a cutting profile which sweeps across the whole of the bottom of the bore hole being drilled. The three outermost cutters 28 on each primary blade 26 are provided, in known manner, with back up studs 40 mounted on the same primary blade rearwardly of the primary cutters. The back up studs may be in the form of cylindrical studs of tungsten carbide embedded with particles of synthetic or natural diamond.

Secondary cutters 29 are mounted side-by-side along each secondary blade 27 and, again, each secondary cutter 29 is located at the same radial distance from the bit axis as an associated one of the primary cutters on the preceding primary blade. In the arrangement shown the primary and secondary cutters are both of the same diameter but, as previously mentioned, the secondary cutters might also be smaller or larger in diameter than the primary cutters.

Mounted in the body of the drill bit are nozzles 30 through which drilling fluid is delivered to the face of the drill bit so as to flow outwardly through the spaces between adjacent blades to junk slots leading to the annulus between the drill string and the side walls of the bore hole.

As will be seen from the drawings, although the secondary blades are equally spaced with respect to one another, each secondary blade is closer to its associated preceding primary blade than it is to the following primary blade. The effect of this is that the space 31 and junk slot 32 in front of each primary blade 26 is larger than the space 33 and junk slot 34 in front of each secondary blade 27. The "flow volume" in front of each blade is defined as the volume enclosed between the blades, the bit body and the surrounding formation, and the arrangement is therefore such that the flow volume in front of each primary blade 26 is greater than the flow volume in front of each secondary blade 27. This thereby enhances the cooling and cleaning of the primary cutters 28 which perform most of the cutting function of the drill bit whereas the secondary cutters 29 require less volume flow for cleaning and cooling since they perform less cutting.

In the arrangement shown the angular spacing between the primary blades 26 is approximately 90 degrees. The angular spacing between each primary blade and its associated following secondary blade may be in the range of 20–45 degrees, the angle preferably being of the order of the angle shown in FIG. 3.

As in the previously described arrangement, the secondary blades 27 and secondary cutters 29 perform a stabilising and back up function while only performing a small proportion, e.g. 20%, of the cutting function. The drill bit of FIG. 3 and 4 thus performs with similar efficiency to a four-bladed drill bit, but has the stability and redundancy features, and hence wear characteristics, similar to an eight-bladed drill bit.

As best seen from FIG. 4, the junk slots 32 and 34 are separated by secondary gauge pads 35, extending from the extremities of the secondary blades 27, and primary gauge pads 36 extending from the extremities of the primary blades 26. In conventional manner the gauge pads 35 and 36 are formed with cylindrical bearing inserts 37 received in sockets in the gauge pads so as to be flush with the surface thereof. The inserts may be formed from tungsten carbide, in known manner, and some of the inserts, as indicated at 38, may have polycrystalline or natural diamond particles embedded therein.

As may be seen from the drawings, the primary gauge pads 36 at the extremities of the primary blades 26 are wider in the circumferential direction than the gauge pads 35 extending from the extremities of the secondary blades 27. The primary gauge pads 36 are therefore comparatively non-aggressive and do not perform a significant cutting action on the formation of the side wall of the bore hole. The pads therefore serve to provide good stabilisation of the bit in the bore hole. By contrast, the secondary gauge pads 35 have preform cutters 39, similar to the cutters 28 and 29, mounted on the leading side of the lower end thereof. However, modified arrangements are possible where the gauge pads on the secondary blades are of the same, or greater, width than the gauge pads on the primary blades.

FIG. 5 is a diagrammatic end view of a further form of drill bit in accordance with the invention where there are mounted on the bit body 41 two primary blades 42 which are interconnected across the central axis 43 of the bit. The primary blades 42 carry primary cutters indicated diagrammatically at 44 which may be of similar form to those described in the previous arrangements. The cutters 44 are disposed at different radial distances from the bit axis 43 so as to lie generally on a spiral and to define a substantially continuous cutting profile which extends over the whole of the bottom of the bore hole being drilled.

Also provided on the bit body 41 are two secondary blades 45 carrying secondary cutters indicated diagrammatically at 46. As in the previously described arrangements each secondary cutter 46 is disposed at the same radial distance from the bit axis 43 as an associated primary cutter 44 on the preceding primary blade 42. Again as in the previous arrangements, the primary cutters 44 perform most of the cutting function of the drill bit, the secondary cutters 46 providing redundancy and stability. The drill bit therefore performs in similar fashion to a fast drilling two-bladed bit while having the stability and wear characteristics of a four-bladed bit.

The primary and secondary blades are so shaped and disposed that the flow volume 47 in front of each primary blade 42 is greater than the space 48 in front of each secondary blade 45.

The inner extremities of the secondary blades 45 are spaced from the interconnected primary blades 42 so as to define a comparatively narrow throat 49. Nozzles 50 are provided at each side of each throat 49 and it is found that this arrangement provides a particularly effective flow of drilling fluid over the end face of the bit so as to provide efficient cooling and cleaning of the bit and the cutters. The narrow throats 49 provide a venturi effect so as to increase the velocity of drilling fluid flow adjacent the central region of the bit end face thereby reducing the tendency for "bailing" to occur, i.e. the accumulation of comparatively soft cuttings at the face of the bit.

Figure 6:
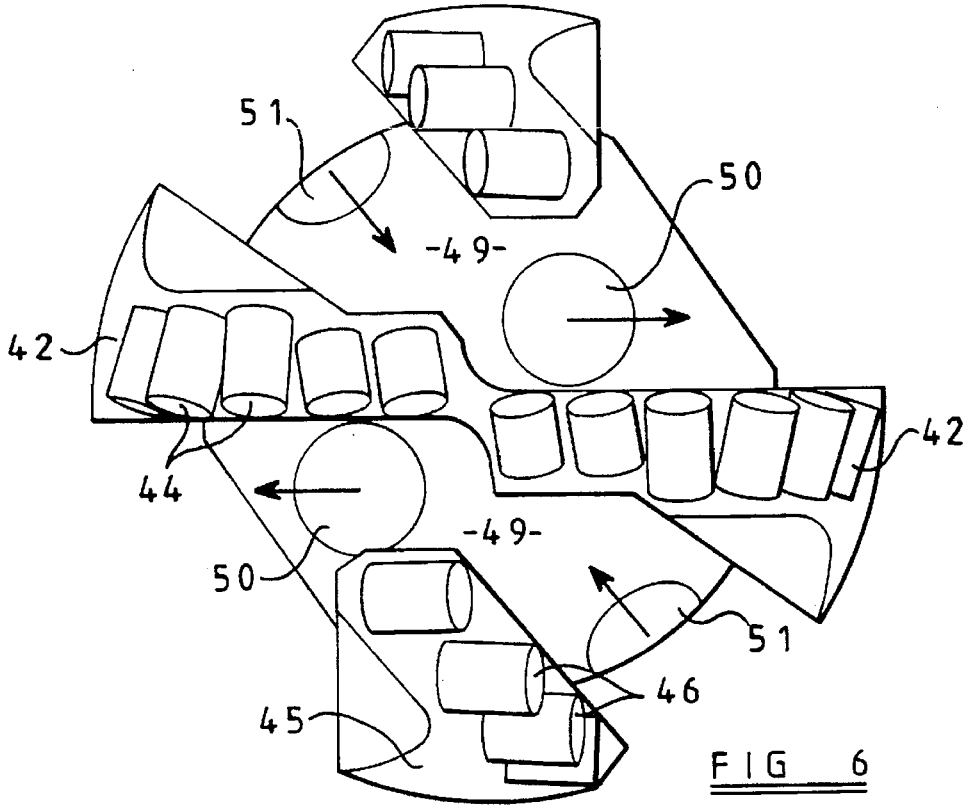

FIG. 6 shows an arrangement which is generally similar to the arrangement of FIG. 5 and corresponding parts are therefore provided with corresponding reference numerals. In the arrangement of FIG. 6, however, two of the nozzles, indicated at 51, are located adjacent the outer periphery of the bit and are so directed that the flow of drilling fluid emerging therefrom flows inwardly towards the central axis of the bit and towards the respective nozzles 50.

Furthermore, whereas in the FIG. 5 arrangement the secondary blades 45 extend generally radially, in the FIG. 6 arrangement the secondary blades 45 are each inclined forwardly with respect to the radial direction so that the angular circumferential separation between the secondary cutters 46 and their associated primary cutters 44 decreases with distance from the bit axis. Normally, as in the FIG. 5 arrangement, the outer secondary cutters 46 would have to do more work than the inner secondary cutters since they follow at a greater circumferential distance behind their associated primary cutters. This effect is reduced in the arrangement of FIG. 6 by reducing the circumferential distance between the outer secondary cutters and their associated primary cutters. This tends to equalise the work carried out by the secondary cutters. The forward inclination of the secondary blades 45 also increases the flow volume in front of the primary blades 42 and decreases the flow volume in front of the secondary blades 45.

The outermost cutters, nearer the side wall of the bore hole being drilled, may be provided with side rake. For example, they may be angled to reduce their cutting effect on the formation and thus to improve the stabilisation of the bit in the bore hole. Alternatively the side rake on the outermost cutters may be such as to displace cuttings inwardly, towards the central axis of rotation of the bit, so that they are more readily entrained in the inward flow of drilling fluid from the outer nozzles 51.

We claim:

1. A rotary drill bit for drilling or coring holes in subsurface formations comprising a bit body having a shank for connection to a drill string, a plurality of circumferentially spaced blades on the bit body each extending outwardly away from the central axis of rotation of the bit, a plurality of cutters mounted side-by-side along each blade, and a passage in the bit body for supplying drilling fluid to the surface of the bit for cleaning and cooling the cutters, wherein the cutters on a series of primary blades are primary cutters at least the majority of which are located at different radial distances from the bit axis so as together to define a cutting profile which, in use, covers substantially the whole of the bottom of the bore hole being drilled, and wherein at least the majority of the cutters on a series of secondary blades are secondary cutters each of which is located at substantially the same radial distance from the bit axis as an associated primary cutter, both the primary cutters and the secondary cutters each comprising a preform cutting element having a front facing table of polycrystalline diamond bonded to a substrate of less hard material, each front facing table being inclined forwardly, in the normal direction of forward rotation of the drill bit, as the facing table extends away from the cutting profile and towards the bit body, and the width of the facing table of each secondary cutter being no greater than the width of its associated primary cutter so that, in use, each secondary cutter follows along a groove cut in the formation by its associated primary cutter.

2. A rotary drill bit according to claim 1, wherein the blades extend generally radially outwards from the bit axis.

3. A rotary drill bit according to claim 1, wherein each secondary blade carrying secondary cutters is the next adjacent blade rearwardly of the primary blade which carries the primary cutters associated with those secondary cutters.

4. A rotary drill bit according to claim 1, wherein the flow volume associated with each primary blade is greater than the flow volume associated with each secondary blade, where the flow volume comprises the space which, in use, is enclosed between said blade, the preceding blade, the bit body, and the surrounding formation.

5. A rotary drill bit according to claim 4, wherein the secondary blades are so located that the angular separation between each secondary blade and its preceding primary blade is less than its angular separation from the following primary blade.

6. A rotary drill bit according to claim 1, wherein the number of secondary blades is equal to the number of primary blades, each secondary blade being located between two circumferentially spaced primary blades.

7. A rotary drill bit according to claim 6, wherein there are provided three primary blades and three secondary blades.

8. A rotary drill bit according to claim 6, wherein there are provided four primary blades and four secondary blades.

9. A rotary drill bit according to claim 1, wherein the primary blades are substantially equally circumferentially spaced around the bit body, and the secondary blades are also substantially equally circumferentially spaced around the bit body.

10. A rotary drill bit according to claim 1, wherein the cutting element is bonded to a support post or stud which is received in a socket in the bit body.

11. A rotary drill bit according to claim 1, wherein the substrate is of sufficient length that it may be directly received in a socket in the bit body.

12. A rotary drill bit according to claim 1, wherein there is provided at the outer extremity of each blade a gauge pad which, in use, bears on the side wall of the bore hole being drilled, the primary gauge pads, at the extremities of the primary blades, being of greater circumferential width than the secondary gauge pads at the extremities of the secondary blades.

13. A rotary drill bit according to claim 1, wherein there is provided at the outer extremity of each blade a gauge pad which, in use, bears on the side wall of the bore hole being drilled, the secondary gauge pads, at the extremities of the secondary blades, being of greater circumferential width than the primary gauge pads at the extremities of the primary blades.

14. A rotary drill bit according to claim 1, wherein there is provided at the outer extremity of each blade a gauge pad which, in use, bears on the side wall of the bore hole being drilled, the secondary gauge pads, at the extremities of the secondary blades, being of substantially the same circumferential width as the primary gauge pads at the extremities of the primary blades.

15. A rotary drill bit according to claim 1, wherein there is provided at the outer extremity of each blade a gauge pad which, in use, bears on the side wall of the bore hole being drilled, the primary gauge pads, at the extremities of the primary blades, being adapted to have less cutting or abrading effect on the formation than the secondary gauge pads at the extremities of the secondary blades.

16. A rotary drill bit according to claim 1, wherein there are provided two primary blades and two secondary blades, the primary blades being interconnected at the central axis of the bit, and the inner extremities of the secondary blades being spaced from the bit axis so that the flow volumes preceding and following each secondary blade are interconnected by a throat portion between the inner extremity of the secondary blade and the interconnected primary blades.

17. A rotary drill bit according to claim 1, wherein the relative orientations of a secondary blade and its associated primary blade are such that the angular circumferential separation between the secondary cutters and their associated primary cutters decreases with distance from the bit axis.

18. A rotary drill bit according to claim 1, wherein the paths swept by the cutting edges of said primary cutters define a primary cutting profile and wherein the cutting edges of at least some of said secondary cutters lie substantially on said cutting profile.

19. A rotary drill bit according to claim 1, wherein the paths swept by the cutting edges of said primary cutters define a primary cutting profile and wherein the cutting edges of at least some of said secondary cutters lie nearer to the bit body than said cutting profile.

20. A rotary drill bit according to claim 1, wherein the paths swept by the cutting edges of said primary cutters define a primary cutting profile and wherein the cutting edges of at least some of said secondary cutters lie further from the bit body than said cutting profile.

21. A rotary drill bit for drilling or coring holes in subsurface formations, comprising a bit body having a shank for connection to a drill string, a plurality of circumferentially spaced blades on the bit body each extending outwardly away from the central axis of rotation of the bit, a plurality of cutters mounted side-by-side along each blade, and a passage in the bit body for supplying drilling fluid to the surface of the bit for cleaning and cooling the cutters, wherein the cutters on a series of primary blades are primary cutters at least the majority of which are located at different radial distances from the bit axis so as together to define a cutting profile which, in use, covers substantially the whole of the bottom of the bore hole being drilled, and wherein at least the majority of the cutters on a series of secondary blades are secondary cutters each of which is located at substantially the same radial distance from the bit axis as an associated primary cutter, and there being provided at the outer extremity of each blade a gauge pad which, in use, bears on the side wall of the bore hole being drilled, the primary gauge pads, at the extremities of the primary blades, including only bearing or abrading elements which are substantially flush with the surface of the gauge pad so as to have less cutting or abrading effect on the formation than the secondary gauge pads at the extremities of the secondary blades, each secondary gauge pad including gauge cutters which project outwardly beyond the surface of the gauge pad for removal of material from the surrounding formation.

22. A rotary drill bit for drilling or coring holes in subsurface formations, comprising a bit body having a shank for connection to a drill string, a plurality of circumferentially spaced blades on the bit body each extending outwardly away from the central axis of rotation of the bit, a plurality of cutters mounted side-by-side along each blade, and a passage in the bit body for supplying drilling fluid to the surface of the bit for cleaning and cooling the cutters, wherein the cutters on a series of primary blades are primary cutters at least the majority of which are located at different radial distances from the bit axis so as together to define a cutting profile which, in use, covers substantially the whole of the bottom of the bore hole being drilled, and wherein at least the majority of the cutters on a series of secondary blades are secondary cutters each of which is located at substantially the same radial distance from the bit axis as an associated primary cutter, each primary blade extending generally radially with respect to the bit axis, and each secondary blade being inclined forwardly with respect to the radial direction, so that the angular circumferential separation between each secondary cutter and its associated primary cutter decreases with distance from the bit axis.

* * * * *